US005199186A

United States Patent [19]

Rice et al.

[11] Patent Number: 5,199,186

[45] Date of Patent: Apr. 6, 1993

[54] VACUUM-OPERATED VENEER DRYER

[76] Inventors: Thomas E. Rice, 413 Emerald Cir., Medford, Oreg. 97501; David W. Osborne, 24025 Springbrook Rd., Medford, Oreg. 97504

[21] Appl. No.: 699,503

[22] Filed: May 14, 1991

[51] Int. Cl.[5] ..... F26B 13/30

[52] U.S. Cl. ..... 34/92; 34/143; 34/16.5; 34/242

[58] Field of Search ..... 34/92, 15, 16, 143, 34/145, 148, 151, 5, 144, 16.5, 16, 217, 242

[56] References Cited

U.S. PATENT DOCUMENTS 3,064,363 11/1962 Ikeuchi .
3,521,373 7/1970 Pagnozzi .
4,017,980 4/1977 Kleinguenther .
4,106,209 8/1978 Brown .
4,146,973 4/1979 Steffensen et al. .
4,179,820 12/1979 Steffensen et al. .
4,197,657 4/1980 Leino et al. .
4,233,752 11/1980 Kleinguenther .
4,734,995 4/1988 Pagnozzi et al. .
4,788,778 12/1988 Fernwood ..... 34/92
5,040,312 8/1991 Holzel et al. ..... 34/92

*Primary Examiner*—Henry A. Bennet
*Attorney, Agent, or Firm*—Kolisch Hartwell Dickinson McCormack & Heuser

[57] ABSTRACT

A vacuum dryer that has upper and lower platens brought together against the load handled by the application of a vacuum. A manifold, with means for producing a pressure within the manifold different from atmospheric, is used to seal one platen against the other. A flexible means joins the manifold to a platen whereby they are relatively displaceable.

10 Claims, 2 Drawing Sheets

VACUUM-OPERATED VENEER DRYER

BACKGROUND AND SUMMARY OF THE INVENTION

This invention relates to a dryer, and more particularly to a dryer wherein a vacuum or subatmospheric pressure is established within the dryer, which, together with the application of heat, produces drying of material handled. The dryer is particularly suited for the drying of veneer or similar sheet material which can be prepared as a layered stack within the dryer.

Because the dryer of the invention utilizes a vacuum, moisture within the material being processed vaporizes at a lower temperature than in conventional type dryers. As a consequence, for a given dryer temperature, drying may be performed more rapidly than with other types of dryers. With a lower temperature used in drying, resinous materials which vaporize at the higher temperatures typifying conventional dryers tend not to be vaporized and expelled into the atmosphere. This substantially minimizes pollution problems that characterize conventional dryers.

In a dryer constructed pursuant to the invention, a pair of relatively movable, opposed platens are brought together, and under the action of vacuum press against opposite sides of the load handled. These walls are supported by the load, and there is an absence in the dryer of substantial containment walls that must be adequately braced to withstand the atmospheric pressure which is present on the outside of the dryer. The dryer features a novel construction for sealing one platen against the other, whereby a vacuum may be established within the dryer. The invention further embraces, in one modification thereof, the provision of a conveyor whereby material may be easily transported into and out of the dryer.

A general object of the invention, therefore, is to provide an improved dryer for heating material, such as wood veneer, which relies on the application of heat and also the establishment of a vacuum to produce the drying action.

Another object is to provide such a dryer which has a minimal extent of containment walls functioning to define the limits of a vacuum chamber within the dryer.

Another object is to provide a dryer with improved means for sealing together relatively movable sections in the dryer.

A dryer constructed according to the invention readily adapts itself to the handling of loads of different thickness. A dryer pursuant to the invention may be relatively simply constructed, and at low cost.

BRIEF DESCRIPTION OF THE DRAWINGS

These and other objects are attained by the invention which is described hereinbelow in conjunction with the accompanying drawings, wherein.

DETAILED DESCRIPTION OF A PREFERRED EMBODIMENT

Figure 1:
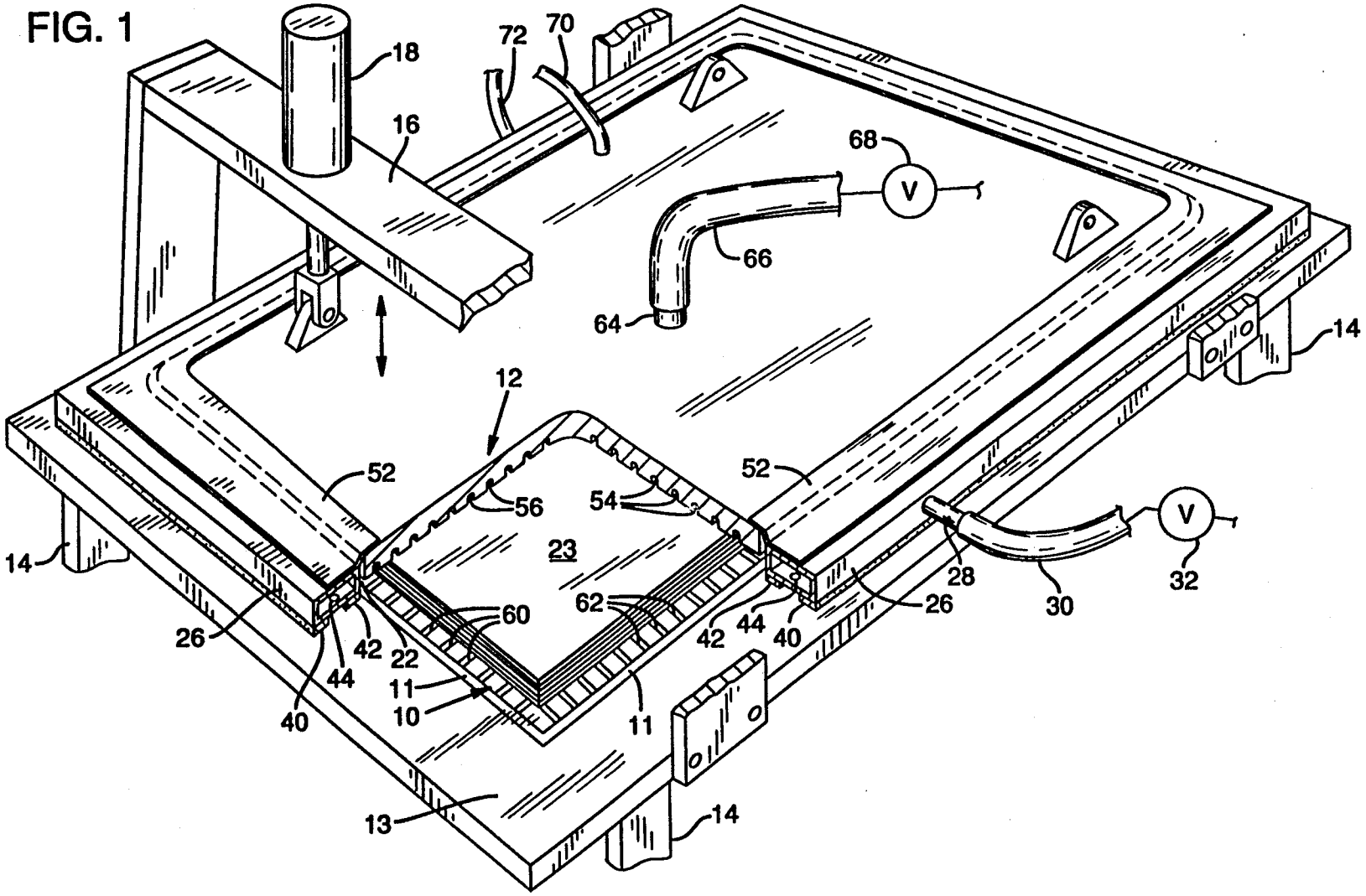
FIG. 1 is a perspective view of a dryer, with portions broken away.

A dryer constructed pursuant to the invention may include a pair of opposed and separable plates or platens, indicated in the drawings at 10 and 12. Lower platen is suitably connected, through a ribbon of heat insulating material 11, to a margin plate 13. Elements 10, 11, and 13 together form one rigid structure. In the particular form of the invention illustrated, the platens are of substantially rectangular outline. In details of construction, however, the platens of different dryers may vary from one dryer to another.

The platens ordinarily are prepared from a heat conductive material, such as a metal. In the units that I have made, platens composed of aluminum have performed entirely satisfactorily.

The lower platen is conveniently supported on a base or frame, such as is partially illustrated at 14. The upper platen, as already mentioned, is separable from the lower one. The upper platen, for convenience, may be hinged or otherwise supported relative to the lower platen in a removable fashion (to permit entry to the interior of the dryer). As illustrated in FIG. 1, the upper platen is movably supported over the lower one on framework 16, with hydraulically actuated rams such as ram 18 providing a means for adjustably raising and lowering the platen.

During operation of a dryer, a chamber 22 is formed between the lower surface of the upper platen and the upper surface of the lower platen, and this chamber receives the material 23 to be dried, such as a sheet or stack of sheets of veneer. To establish a sealed relation between the platens, whereby a vacuum or subatmospheric condition may be established within the dryer chamber, means is provided extending about the perimeter of a platen whereby such may be sealed to the platen opposite.

Specifically, and with reference to the dryer shown in FIG. 1, the seal provided takes the form of an elongate hollow manifold, shown at 26, extending as a continuous rectangular loop about the perimeter of upper platen 12. The manifold, which specifically may take the form of elongate rectangular tubing, is connectable to a vacuum source, such as a vacuum pump, through fitting 28, tube 30, and valve 32.

Extending along the base of the manifold is a double seal construction. This includes one elongate sealing strip 40 extending in a continuous course along the underside of the manifold, and spaced laterally from this strip, another sealing strip 42, also extending in such a continuous course. The strips may be made of foam rubber or either elastomer material. Thus, they are deformable to provide a tight seal with the platen surface provided thereunder.

The manifold along its length is provided with apertures or ports, such as the one shown at 44. These provide fluid communication between the interior of the manifold and the space existing being sealing strips 40, 42. The strips form what is referred to herein as an elongate vacuum mouth. With a subatmospheric pressure or vacuum established within the manifold, such vacuum also exists between the sealing strips. Atmospheric pressure then causes the manifold to be forced downwardly through the sealing strips against the platen surface thereunder. Establishing a vacuum within the manifold quickly produces a sealed relationship between the manifold and the platen thereunder. With the vacuum broken, release is immediate.

The manifold and associated structure is connected to adjacent margins of platen 12 through a flexible means permitting the manifold and platen 12 to have different elevations with respect to platen 10 beneath it. In this way, different heights of material may be handled, with a seal still established.

Specifically, shown at 52 is an elongate, flexible, air impervious strip, with an inner margin joined and thus sealed to platen 12, and an outer margin joined and thus sealed to manifold tube 26. The strip, which may be made of a suitable elastomer material, is flexible and resilient. This enables the manifold to have different positions with respect to platen 12.

The face of platen 12 which faces downwardly is formed with a set of elongate parallel grooves shown at 54 and these intersect with another set of elongate parallel grooves 56. The grooves thus all interconnect with each other. The grooves provide an air-passage means extending over the face of the platen accommodating air movement between regions located interiorly of the chamber or space 22 and a region located adjacent manifold 26. When a vacuum is initiated within press chamber 26, this passage means promotes the movement of air while such is being expelled from the chamber. Furthermore, the passage means accommodates the movement of moisture and other gases from the chamber to outside the dryer during the drying process.

A similar set of grooves, such as those shown at 60 and 62, may be provided in the upper face of the lower platen 10 with such grooves performing a similar function.

A hollow fitting 64, tube 66, and valve 68 connecting with a vacuum source are provided for establishing a vacuum within the dryer. The fitting has an interior communicating with dryer chamber 22.

Means is also provided for heating the space within the dryer. Specifically, shown at 70, 72 are conductors leading to the upper and lower platens, respectively. These connect with conventional electrical heating elements embedded within the upper and lower platens 12, 10.

Because the vacuum within the main drying chamber and within the sealing means may be separately regulated, the pressure within the drying chamber may be set at the level determined to be the optimum for the amount of moisture handled, etc. The vacuum within the mouth of the sealing means is adjusted to produce the seal required with this being the main purpose of this vacuum.

Figure 3:
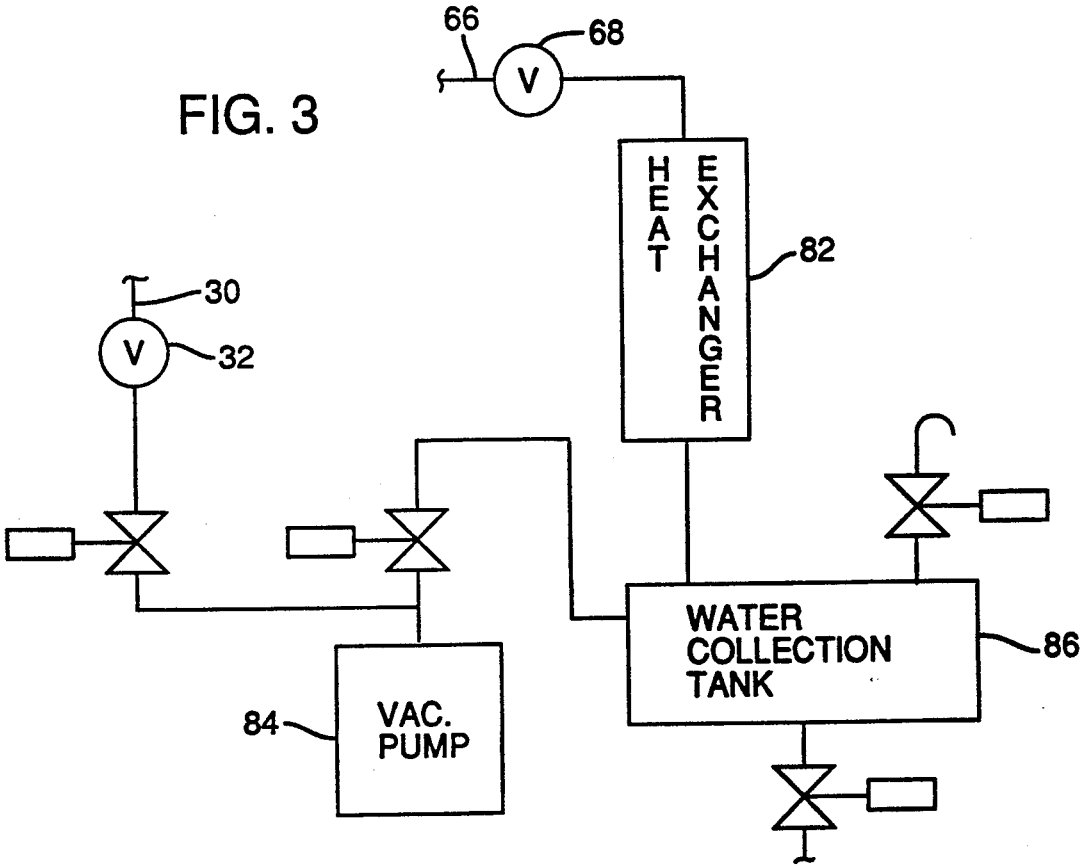
FIG. 3 is a schematic showing details of how a vacuum may be produced in the dryer.

FIG. 3 illustrates schematically how a vacuum may be produced within the vacuum chamber and how moisture removed from the chamber may be condensed. Thus, the tube 66 leads to a heat exchanger 82. A vacuum source 84 connects with the heat exchanger and is operable to produce a vacuum within the exchanger and tube 30. Moisture condensed within the heat exchanger flows by gravity downwardly from the exchanger to be collected in a collection tank 86.

Figure 2:
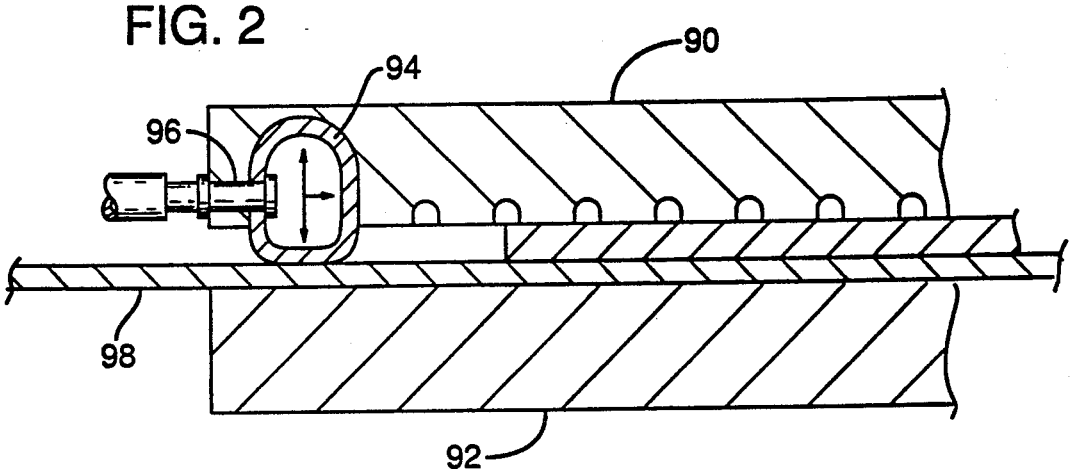
FIG. 2 is a cross-sectional view, showing a modified form of a dryer.

In FIG. 2, there are illustrated portions of a modified form of a dryer. In the dryer of FIG. 2, a seal is provided between upper platen 90 and lower platen 92, by an elongate continuous length of tubing 94, which may have flexible walls and may resemble, for instance, a continuous length of hose. The interior of this tubing is connected, through a fitting 96, with a source of air under pressure. Air under pressure is introduced to the interior of the hose to extend the hose whereby such throughout its length projects to the extent permitted by the construction of the hose downwardly from the bottom surface of platen 90. With the upper platen drawn downwardly toward the lower platen, by establishing a vacuum within the dryer, the hose is pressed against the surface beneath it to establish a seal.

In the modification shown in FIG. 2, a run 98 of an elongate continuous conveyor belt is shown. This belt has its lower surface slidably supported on the top of platen 92. The conveyor belt enables material to be conveyed into the interior of the dryer without handling of the operator.

In using the belt, atmospheric pressure is established within the dryer. This enables upper platen 90 to be lifted upwardly from conveyor belt run 98. The conveyor belt is moved to transport the load that was in the dryer to a region that is outside the dryer and to replace this load with another load supported on the conveyor run. With this other load properly positioned between the two platens, belt movement is stopped. The upper platen then is lowered toward the lower one to place hose or tubing 94 against the top of the conveyor belt. A vacuum may then be reestablished within the dryer chamber.

While various modifications of the invention have been described, obviously, further modifications and variations are possible without departing from the invention. It is desired to cover all such modifications and variations that come within the scope of the invention.

What is claimed and Desired to Secure by Letters Patent:

1. A dryer comprising a substantially flat first platen and an opposed substantially flat second platen and the platens being relatively movable toward and away from each other, elongate continuous sealing means interposed between the platens and circumscribing a void region located between the platens, said void region being adapted to receive a load of material with the load being bounded on opposite sides by the platens, means for introducing heat to said void region, means for evacuating said void region with the withdrawal of gas therefrom, means for evacuating said void region with the withdrawal of gas therefrom, said sealing means comprising an elongate manifold, means forming an elongate vacuum mouth extending along the length of the manifold, a fluid communication established between the manifold and said vacuum mouth and a vacuum source connecting with said manifold, and flexible air-impervious means extending from the manifold and joining the manifold to one of said platens whereby the manifold is sealed to said one platen, but permitting relative movement of the manifold with respect to said one platen.

2. The dryer of claim 1, which further comprises passage means extending over the face of at least one platen accommodating air movement between regions located in the interior of said space to regions located adjacent said sealing means.

3. The dryer of claim 1, wherein said first platen is at one elevation and substantially horizontal and said second platen is disposed above said first platen, said second platen being movable upwardly and away from said first platen to accommodate loading of the dryer and which further includes a conveyor belt extending over the top of said first platen for the conveying of material into a operative position above said first platen.

4. A dryer comprising:

a first rigid platen, an elongate continuous sealing means disposed against said first platen with the sealing means circumscribing a void region, the void region being bounded on one side by said first platen, said sealing means being separable from the first platen to permit loading of the dryer, a second rigid platen disposed over the first platen and movable away from the first platen when loading the dryer and bounding an opposite side of said void region, and flexible impervious means extending from said sealing means to the margins of said second platen, said sealing means comprising an elongate manifold, and pressure-differential means for establishing within the manifold a pressure different from atmospheric.

5. The dryer of claim 4, wherein said sealing means further comprises means extending along said manifold forming an elongate vacuum mouth, and means producing fluid communication between said manifold and said vacuum mouth, said pressure-differential means comprising a vacuum source.

6. The press of claim 5, which further includes an elongate conveyor belt having a run extending over said first platen between the platen and said sealing means.

7. The dryer of claim 6, further comprising a vacuum source connectable with said void region for establishing a subatmospheric pressure in said void region, the vacuum source for said void region and the vacuum source for the manifold being independently regulatable.

8. A dryer comprising a substantially flat first platen and an opposed substantially flat second platen and the platens being relatively movable toward and away from each other, elongate continuous sealing means interposed between the platens and circumscribing a void region located between the platens, said void region being adapted to receive a load of material with the load being bounded on opposite sides by the platens, means for evacuating said void region with the withdrawal of gas therefrom, said sealing means comprising an elongate manifold, and means for establishing within the manifold a pressure different from atmospheric pressure, said second platen being disposed over said first platen and movable away from the first platen to accommodate loading of the dryer and the dryer further including a conveyor belt extending over the top of the first platen for the conveying of material into an operative position above said first piston.

9. In a dryer:

a platen assembly comprising first and second opposed metallic and heat-conductive platens mounted for relative movement toward and away from each other, and means for heating the platen assembly, an elongate sealing structure interposed between the platens extending in a course which circumscribes a void region located between the platens for receiving material to be dried and the sealing structure detachably bearing against said first platen to establish a seal with the first platen, and flexible structure joining the sealing structure to the second platen and serving to mount the sealing structure on the second platen and accommodating different relative positions of the platens with a seal established between the sealing structure and the first platen.

10. The dryer of claim 9, wherein the sealing structure comprises means forming an elongate vacuum mouth extending the length of the sealing structure and which further comprises a vacuum source connected to the vacuum mouth to provide a vacuum thereto.

* * * * *